United States Patent [19]

Burns

[11] Patent Number: 4,893,361

[45] Date of Patent: Jan. 16, 1990

[54] DRAIN TRAP ULTRASONIC VIBRATION CLEANING APPARATUS

[76] Inventor: Paul H. Burns, 394 W. Webster, Ferndale, Mich. 48220

[21] Appl. No.: 136,386

[22] Filed: Dec. 22, 1987

[51] Int. Cl.[4] ..... E03C 1/30

[52] U.S. Cl. ..... 4/255; 134/169 C; 134/113; 134/1; 134/22.11; 15/104.31

[58] Field of Search ..... 4/255, 256, 257; 137/238; 15/104.07, 104.31; 134/1, 22.1, 22.11, 57 R, 58 R, 166 C, 167 C, 169 C, 113; 138/DIG. 3; 210/97, 137

[56] References Cited

U.S. PATENT DOCUMENTS

| | | | |
|---|---|---|---|
| 1,437,582 | 12/1922 | Bahr | 4/257 |
| 2,039,467 | 5/1936 | Walsh | 4/255 |
| 2,171,710 | 9/1939 | Perry | 4/257 |
| 2,452,367 | 10/1948 | Gangloff | 134/22.11 |
| 2,610,696 | 9/1952 | Mayberry | 137/242 |
| 3,050,786 | 8/1962 | St. John et al. | 138/DIG. 3 |
| 3,175,567 | 3/1965 | Crawford | 134/1 |
| 3,421,939 | 1/1969 | Jacke | 134/1 |
| 3,783,457 | 1/1974 | Tornabene | 4/255 |
| 3,872,521 | 3/1975 | Friedman | 4/255 |
| 4,388,741 | 6/1983 | Breon | 4/255 |
| 4,762,688 | 8/1988 | Loose et al. | 15/104.07 |

*Primary Examiner*—Henry J. Recla
*Assistant Examiner*—J. Casimer Jacyna
*Attorney, Agent, or Firm*—Gifford, Groh, Sheridan, Sprinkle and Dolgorukov

[57] ABSTRACT

An ultrasonic drain trap cleaning apparatus for use in a plumbing system. A drain trap is fitted with transducers which receive electrical signals from a signal generator to create vibrations within the trap thereby clearing clogging material. A flow sensor is optionally provided to check fluid flow. If fluid flow is inadequate, the sensor signals the generator to generate signals to the transducers, causing vibrations thereby. A central programmable generator may be provided to generate electrical signals to more than one trap having transducers, or a programmable generator may be provided at each trap.

13 Claims, 1 Drawing Sheet

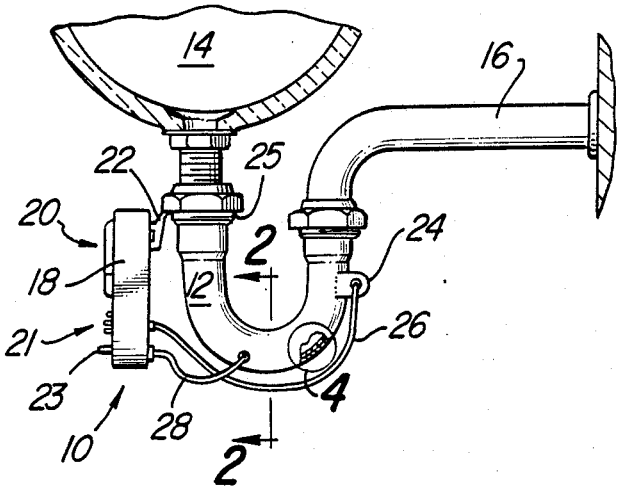
Fig-1
Fig-4
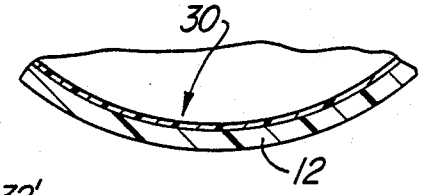
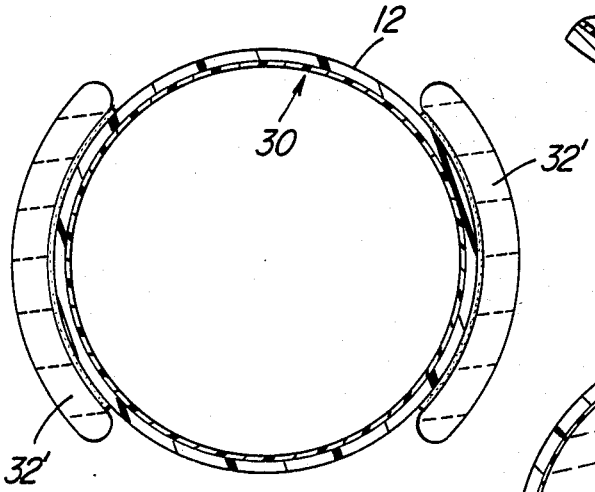
Fig-3
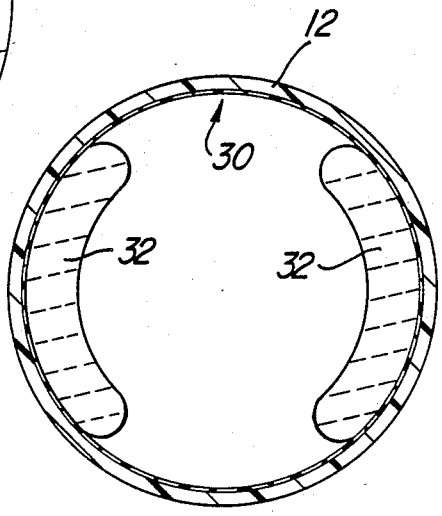
Fig-2

DRAIN TRAP ULTRASONIC VIBRATION CLEANING APPARATUS

BACKGROUND OF THE INVENTION

I. Field of the Invention

The present invention relates generally to drain trap cleaning apparatus, and particularly to a drain trap cleaning apparatus which utilizes ultrasonic vibrations to clear away clogging material and to prevent build-up of the same.

II. Description of the Prior Art

In a drain trap, build-up of clogging materials has long been a menace to both home owners and commercial building owners alike. Chemical drain cleaners are well known, although in many instances the caustic character of such cleaners render them too harsh for safe environmental of functional use and, even where considered safe, such products have proven less than satisfactory in service.

Hand- or power-operated drain "snakes" have also been employed, but such operation often exceeds the ability or will of the typical home owner, ultimately requiring the introduction of costly and inconvenient plumbing services.

In attempts to meet the need of reliable, convenient and inexpensive drain trap cleaning mechanisms, various "built-in" devices have been devised. Such devices include built-in "snakes" and other mechanisms to facilitate cleaning and clearing. Some of these devices are manually operated, while others are motorized.

Common to the prior art, however, is the complexity and related unreliability associated with mechanical devices. In addition, such devices are essentially restricted to being "built-in", because it is entirely impractical to add mechanical drain trap cleaners to existing plumbing.

Furthermore, with the use of mechanised drain trap cleaners, one must be prepared to expend considerable time and money in maintaining and repairing such devices. Having a built-in mechanical drain trap cleaner break down is probably a worse end than the clog which the device was installed to prevent.

A further disadvantage of the known devices is the inability of such cleaners to react by themselves to the formation of clogs or to operate by a pre-programmed, regular schedule.

SUMMARY OF THE PRESENT INVENTION

The present invention provides a drain trap cleaning apparatus which overcomes all the above-mentioned disadvantages of the previously known devices.

In brief, the drain trap cleaning apparatus of the present invention includes ultrasonic transducers which, in the case of new construction, are provided integrally within drain traps or, in the case of existing plumbing, are attached to the exterior of the drain trap. An electrical signal generator is provided to send electrical signals to the transducers.

The electrical signals from the generator produce electrical oscillations in the transducers causing corresponding mechanical vibrations which are transferred to the material present within the drain trap.

The drain trap cleaning apparatus may be centrally operated having a central electrical signal generator or may be provided on a trap-by-trap basis. In any use, the generator may be programmable so that preselected operating times are established and executed without the need of human intervention.

The generator may also be engaged by signals from a flow rate sensing device provided in the drain trap or associated plumbing downstream from the transducers. If the sensor detects a drop in the flow rate suggesting a possible clogged line, the generator is engaged, ultrasonic vibrations are produced, and the drain is accordingly cleared.

To provide more efficient operation of the apparatus, the inner walls of the plumbing are coatable with a non-sticking material, such as TEFLON (trademark for polytetrafluoroethylene). In addition to preventing material from undesirably sticking to the walls of the plumbing, the coating allows, because of the lack of accumulated material, for efficient movement of ultrasonic vibrations produced by the apparatus.

In addition to overcoming the above-stated disadvantages of the prior art, the present invention provides a measure of preventive maintenance in that the apparatus can effectively be employed to prevent the development of clogs. By having the apparatus operate according to a regular, pre-programmed schedule, clogs can be prevented, whereas the prior art is employed only after the clog develops.

A further advantage of the present invention over the prior art is its relative absence of moving parts. Because of this comparative simplicity, the present invention offers greater reliability and promises lower maintenance than known drain trap cleaners.

The present invention may also be employed in other applications. For example, ultrasonic vibrations may be induced in plumbing through which emulsified liquids are passed, or may be similarly used in degassing solutions passing therethrough.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a side elevational view illustrating a preferred embodiment of the present invention, showing the basin in cross-section and the drain trap in partial section;

FIG. 2 is a cross-sectional view taken substantially along 2—2 in FIG. 1;

FIG. 3 is an alternate embodiment of the device according to the view of FIG. 2; and FIG. 4 is a fragmentary cross-section view detailing 4 of FIG. 1.

DETAILED DESCRIPTION OF THE PREFERRED EMBODIMENTS OF THE PRESENT INVENTION

With reference first to FIG. 1, a preferred embodiment of the drain trap cleaning apparatus, generally indicated by 10, of the present invention is shown and primarily comprises a generator 18 and a drain trap device 12 situated between a basin 14 and an elbow pipe 16. While the generator 18 is shown here attached to a plumbing joint 25 by a bracket 22, it must be appreciated that the genertor 18 may be remotely provided with respect to the drain trap device 12 and may control more than one drain trap device 12 at a time.

According to the preferred embodiment, the generator 18 is provided with a readout 20 and program selector controls 21. Thus provided, the generator may be set to operate at pre-selected times, thereby eliminating the need for human intervention. Programming may be conventionally determined for any given 24-hour period or may be set for longer periods as preferred.

In addition to programmable cleaning, a manual override switch 23 is provided to allow selective operation of the trap device 12. The override switch 23 may be used when the probability of clogging is high, such as during heavy drain use.

If a truly flow-sensitive approach is preferred, the apparatus 10 may include a flow sensor 24 which is located preferably on the drain trap device 12 just prior to the elbow pipe 16. So situated, the flow sensor 24 can detect current rate at a point "downstream" of the transducers (described in detail below) which are located at the approximate lowest point of the drain trap device 12. The flow sensor 24, when sensing that a flow is too slow, signals the generator 18, via flow sensor lead line 26, that the transducers should be energized by elecrical signals generated by the generator 18 and flowing along a generator lead line 28 through a point in the drain trap device 12 to the transducers located therein.

The flow sensor 24 may be driven conventionally by a wheel (not shown), or may be sensed by ultrasonics in the form of a known liquid-level switch.

With reference now to FIG. 2, the heart of the apparatus 10 may be seen in the form of a pair of transducers 32. While a pair of the transducers 32 is shown, ultrasonic vibrations may be established by a lone transducer or by more than two.

The transducers 32 are energized by electrical signals produced by the generator 18 (FIG. 1), creating electrical oscillations within the transducers 32. These oscillations cause corresponding mechanical vibrations which are transferred to the contents of the drain trap device 12. The vibrations shake the solid and semi-solid contents of the drain trap device 12 off of the inner walls of the drain trap 12 and otherwise help to reduce the solid matter into a semi-solid or liquid form, thereby fostering its bypassage through the drain trap device 12. The liquid which is found within the drain trap device 12 is agitated by the vibrations and helps to conduct the vibrations to and through the solid or semi-solid material.

While the construction of the transducers 32 is known in the art, preferably these elements are either piezoelectric transducers or magnetostrictive transducers, the latter being preferred for application to pipes composed of ferromagnetic materials.

The transducers 32 of FIG. 2 are shown disposed within the drain trap device 12. Such construction is preferred in the vent of a building or home under construction where the structure has yet to be fully plumbed. Under such circumstances, the drain trap device 12 of FIG. 2 having the transducers 32 integrally provided is utilized. This embodiment may also be preferred where traps are sought to be replaced.

However, in those anticipated instances where the trap is neither to be newly installed nor replaced, an add-on version of the present invention is desirable. Accordingly, the transducers may be externally mounted on existing traps, as shown in FIG. 3. With reference thereto, a pair of transducers 32' are shown mounted externally in relation to the drain trap device 12. So situated, the transducers 32' effectively operate to establish ultrasonic vibrations within the drain trap device 12.

In both FIGS. 2 and 3 the transducers 32 and 32' respectively are shown mounted within and on the sides of the drain trap device 12. This relationship is preferred to give a better impedance match between the transducers and the contents of the trap device 12, although the transducers 32, 32' may be situated elsewhere.

As a compliment to the present invention, there is optionally, although preferably, provided a non-sticking coating 30 upon the inner walls of the drain trap device 12 shown most clearly in FIG. 4, but also shown in FIGS. 2 and 3. While many such coatings are perhaps known, that manufactured and sold under the trademark TEFLON (polytetrafluoroethylene) is perhaps best suited for the described purpose.

Such coating helps the action of the ultrasounds in that it minimizes the sticking and caking of material to the inner walls of the drain trap device 12, thereby allowing for the better passage of ultrasonic waves therethrough and by reducing the work of the apparatus overall.

From the foregoing, it can be seen that the ultrasonic drain trap cleaning apparatus of the present invention provides a practical, relatively simple and inexpensive solution to the problem of clogged drains which may be adapted and applied to most plumbing situations utilizing drain traps.

Having described my invention, however, many modifications thereto will become apparent to those skilled in the art to which it pertains without deviation from the spirit of the invention as defined by the scope of the appended claims.

I claim:

1. A drain trap cleaning apparatus comprising:

a drain trap body interconnectable with a plumbing system;

one or more transducers fitted within said drain trap body;

said transducers being configured and situated to minimally interfere with the flowthrough of material through said drain trap body;

a flow sensor fixed to said drain trap body;

an electrical signal generator including actuating means selectively operable when said system is in use and electrically interconnected with said transducers and said flow sensor so that said sensor is capable of signalling said electrical signal generator in response to a low fluid flow rate through said system when in use to send electrical signals to said transducers; and said transducers being capable of producing vibrations.

2. A drain trap cleaning apparatus comprising:

means for ultrasonically cleaning and keeping clean a plumbing drain trap and associated plumbing;

means for generating electrical signals to said ultrasonic cleaning means including actuating means selectively operable when said system is in use;

a flow rate sensor means for signalling said generating means when the flow through said drain trap reaches a preselected low flow rate through said system when in use; and said ultrasonic cleaning means being fittable to said plumbing for selectively transferring vibrations to the contents therein.

3. A drain trap cleaning apparatus for plumbing comprising:

one or more transducers fittable to a plumbing drain trap which selectively create vibrations within said trap for preventing the clogging of said trap and said plumbing;

an electrical signal generator including actuating means selectively operable when said system is in use and electrically interconnected with said transducers;

a flow sensor adapted to be interconnected with said plumbing and electrically interconnected with said transducers and said generator so that said sensor is capable of signalling said electrical signal generator in response to a low fluid flow rate through said system when in use to send electrical signals to said transducers; and said transducers being capable of producing ultrasonic vibrations.

4. A drain trap cleaning apparatus comprising:

a drain trap body interconnectable with a plumbing system;

one or more transducers fitted within said drain trap body;

said transducers being configured and situated to minimally interfere with the flowthrough of material through said drain trap body;

a flow sensor fixed to said drain trap body;

an electrical signal generator including actuating means selectively operable when said system is in use and electrically interconnected with said transducers and said flow sensor so that said sensor is capable of signalling said electrical signal generator in response to a low fluid flow rate through said system when in use to said electrical signals to said transducers; and said transducers being capable of producing ultrasonic vibrations.

5. A drain trap cleaning apparatus for plumbing comprising:

one or more transducers fittable to a plumbing drain trap which selectively create vibrations within said trap for preventing the clogging of said trap and said plumbing;

an electrical signal generator including actuating means selectively operable when said system is in use and electrically interconnected with said transducers;

said transducers being provided within said drain trap;

a flow sensor adapted to be interconnected with said plumbing and electrically interconnected with said transducers and said generator so that said sensor is capable of signalling said electrical signal generator in response to a low fluid flow rate through said system when in use to send electrical signals to said transducers; and said transducers being capable of producing ultrasonic vibrations.

6. A drain trap cleaning apparatus for plumbing comprising:

one or more transducers fittable to a plumbing drain trap which selectively create vibrations within said trap for preventing the clogging of said trap and said plumbing;

an electrical signal generator including actuating means selectively operable when said system is in use and electrically interconnected with said transducers;

said transducers being provided exteriorly contiguous to said drain trap;

a flow sensor interconnected with said plumbing and electrically interconnected with said transducers and said generator so that said sensor is capable of signalling said electrical signal generator in response to a low fluid flow rate through said system when in use to send electrical signals to said transducers; and said transducers being capable of producing ultrasonic vibrations.

7. A drain trap cleaning apparatus for plumbing comprising:

one or more transducers fittable to a plumbing drain trap which selectively create vibrations within said trap for preventing the clogging of said trap and said plumbing;

an electrical signal generator including actuating means selectively operable when said system is in use and electrically interconnected with said transducers;

a flow sensor adapted to be interconnected with said plumbing and electrically interconnected with said transducers and said generator so that said sensor is capable of signalling said electrical signal generator in response to a low fluid flow rate through said system when in use to send electrical signals to said transducers;

said transducers being capable of producing ultrasonic vibrations; and said generator being capable of generating electrical signals to more than one of said transducers.

8. The drain cleaning apparatus according to claim 7, wherein said generating means includes a programmable memory portion.

9. A drain trap cleaning apparatus for plumbing comprising:

one or more transducers fittable to a plumbing drain trap which selectively create vibrations within said trap for preventing the clogging of said trap and said plumbing:

an electrical signal generator including actuating means selectively operable when said system is in use and electrically interconnected with said transducers;

a flow sensor adapted to be interconnected with said plumbing and electrically interconnected with said transducers and said generator so that said sensor is capable of signalling said electrical signal generator in response to a low fluid flow rate through said system when in use to send electrical signals to said transducers;

said transducers being capable of producing ultrasonic vibrations; and said generator being capable of generating electrical signals to one of said transducers.

10. The drain cleaning apparatus according to claim 9, wherein said generating means includes a programmable memory portion.

11. A drain trap cleaning apparatus for plumbing comprising:

one or more transducers fittable to a plumbing drain trap which selectively create vibrations within said trap for preventing the clogging of said trap and said plumbing;

an electrical signal generator including actuating means selectively operable when said system is in use and electrically interconnected with said transducers;

a flow sensor adapted to be interconnected with said plumbing and electrically interconnected with said transducers and said generator so that said sensor is capable of signalling said electrical signal generator in response to a low fluid flow rate through said system when in use to send electrical signals to said transducers;

said transducers being capable of producing ultrasonic vibrations; and said plumbing being interiorly coated with a non-sticking coating.

12. A drain trap cleaning apparatus for plumbing comprising:

one or more transducers fittable to a plumbing drain trap which selectively create vibrations within said trap for preventing the clogging of said trap and said plumbing;

an electrical signal generator including acutating means selectively operable when said system is in use and electrically interconnected with said transducers;

a flow sensor adapted to be interconnected with said plumbing and electrically interconnected with said transducers and said generator so that said sensor is capable of signalling said electrical signal generator in response to a low fluid flow rate through said system when in use to send electrical signals to said transducers;

said transducers being capable of producing ultrasonic vibrations; and said flow sensor being responsive to a preselected rate of flow of material through said plumbing.

13. A drain trap cleaning apparatus comprising:

means for ultrasonically cleaning and keeping clean a plumbing drain trap and associated plumbing;

means for generating electrical signals to said ultrasonic cleaning means including actuating means selectively operable when said system is in use;

means for sensing the flowthrough of fluid in said plumbing drain trap and said plumbing, said means for sensing acting in response to a low fluid flow rate through said systems when in use and being electrically interconnected with said means for generating; and said ultrasonic cleaning means being fittable to said plumbing for selectively transferring vibrations to the contents therein.

* * * * *

UNITED STATES PATENT AND TRADEMARK OFFICE

CERTIFICATE OF CORRECTION

PATENT NO. : 4,893,361

DATED : January 16, 1990

INVENTOR(S) : Paul H. Burns

It is certified that error appears in the above-identified patent and that said Letters Patent is hereby corrected as shown below:

On the Abstract Page, item [76], delete "394 W. Webster" and insert --831 Livernois--.

Column 1, line 19, delete "of" and insert --or--.

Column 2, line 64, delete "genertor" and insert --generator--.

Column 4, line 10, delete "compliment" and insert --complement--.

Column 7, claim 12, line 24, delete "acutating" and insert --actuating--.

Signed and Sealed this

Sixth Day of August, 1991

*Attest:*

*Attesting Officer*

HARRY F. MANBECK, JR.

*Commissioner of Patents and Trademarks*